US012760528B2

(12) United States Patent
Henrich et al.

(10) Patent No.: US 12,760,528 B2
(45) Date of Patent: Oct. 13, 2026

(54) INTERLOCKING SURFACE PANEL CLIPS

(71) Applicant: Eagle Aluminum, LLC, Loretto, MN (US)

(72) Inventors: Thomas Henrich, Loretto, MN (US); Jonathan Kurtz, Loretto, MN (US); Ian Cochran, Loretto, MN (US); Brett Carlson, Loretto, MN (US); Shawn Reese, Loretto, MN (US)

(73) Assignee: EAGLE ALUMINUM, LLC, Loretto, MN (US)

( * ) Notice: Subject to any disclaimer, the term of this patent is extended or adjusted under 35 U.S.C. 154(b) by 192 days.

(21) Appl. No.: 18/664,937

(22) Filed: May 15, 2024

(65) Prior Publication Data

US 2025/0354388 A1 Nov. 20, 2025

(51) Int. Cl.
*E04F 13/08* (2006.01)

(52) U.S. Cl.
CPC ..... *E04F 13/0851* (2013.01)

(58) Field of Classification Search
CPC . E04F 13/083; E04F 13/0816; E04F 13/0812; E04F 13/0803; E04F 13/24; E04F 13/0851; E04F 13/081; A47G 1/1606
See application file for complete search history.

(56) References Cited

U.S. PATENT DOCUMENTS 3,117,353 A * 1/1964 Edwards ..... E04F 13/0835 403/403
7,096,629 B1 8/2006 Cox
7,726,083 B2 6/2010 Wagner
7,805,899 B2 10/2010 Montgomery
7,810,289 B2 10/2010 Montgomery
8,191,327 B2 6/2012 Griffiths et al.
8,205,395 B2 6/2012 Jakiel
8,584,425 B2 11/2013 Wagner et al.
9,068,358 B2 6/2015 MacDonald et al.
9,080,331 B2 7/2015 Aboukhalil
9,169,653 B2 10/2015 Porter
9,181,711 B2 11/2015 Bordener
9,595,911 B2 3/2017 McPheeters
9,609,964 B1 4/2017 Munson
9,650,790 B2 5/2017 Bordener
9,783,993 B2 10/2017 Gleeson et al.
10,041,256 B2 8/2018 Scully et al.
10,508,454 B2 12/2019 Suzuki
10,550,577 B2 2/2020 Aboukhalil
(Continued)

*Primary Examiner* — Gisele D Ford
(74) *Attorney, Agent, or Firm* — HSML P.C.

(57) ABSTRACT

Interlocking clips include a first clip and a second clip. The first and second clips each include a baseplate, a coupling arm protruding from the baseplate, and a groove defined by the coupling arm. The baseplates of the first and second clips configured to affix to a building support and the surface panel, respectively. The groove includes an inlet opening, an inlet portion extending from the inlet opening, and an end portion extending from the inlet portion. The grooves of the first clip and the second clip are configured to receive the coupling arm of the other one of the first clip and the second clip. A surface panel support system includes interlocking clips. A method of attaching a surface panel to a building support includes interlocking a first clip affixed to the surface panel with a second clip affixed to the building support.

20 Claims, 11 Drawing Sheets

(56) References Cited

U.S. PATENT DOCUMENTS

| | | | | |
|---|---|---|---|---|
| 10,876,299 | B2 | 12/2020 | Dye | |
| 10,900,227 | B2 | 1/2021 | Maley et al. | |
| 11,286,674 | B2 | 3/2022 | Loyd et al. | |
| 11,371,236 | B2 * | 6/2022 | Saroka | E04B 2/7453 |
| 11,629,506 | B1 | 4/2023 | Ferguson | |
| 2003/0038222 | A1 * | 2/2003 | Holmes | A47G 1/1606 248/490 |
| 2006/0156679 | A1 * | 7/2006 | Pierret | A44B 17/00 52/698 |
| 2009/0241444 | A1 | 10/2009 | Griffiths | |
| 2009/0272055 | A1 | 11/2009 | Griffiths | |
| 2020/0173173 | A1 * | 6/2020 | Dye | E04F 13/14 |
| 2022/0064961 | A1 | 3/2022 | Briggs et al. | |

* cited by examiner

INTERLOCKING SURFACE PANEL CLIPS

FIELD

This disclosure relates to surface panels used in buildings. In particular, this disclosure relates to systems and devices for mounting interior surface panels in buildings.

BACKGROUND

Buildings include interior walls and ceilings that divide the interior of the building into rooms. The interior walls/ceilings of buildings can be made of a variety of materials and constructed in a variety of ways. Generally, the interior walls/ceilings are affixed to support structures of a building. The interior walls/ceilings may be provided by affixing surface panels to support structures in the building.

SUMMARY

In an embodiment, interlocking clips for a surface panel mounting system include a first clip configured to affix to a building support and a second clip configured to affix to a surface panel. The first clip and the second clip each respectively include a baseplate, a coupling arm, and a groove defined by the coupling arm. The baseplate is configured to affix to a respective one of the building support or the surface panel. The coupling arm protrudes from the baseplate and has an end tip. The groove includes an inlet opening, an inlet portion extending from the inlet opening, and an end portion extending from the inlet portion in a different direction than the inlet portion. The inlet opening and the end portion of the groove are each defined by the end tip of the coupling arm. For each of the first clip and the second clip, the groove is configured to receive the coupling arm of a respective other one of the first clip and the second clip.

In an embodiment, a method is directed to attaching a surface panel to a building support. The method includes interlocking a first clip affixed to the surface panel with a second clip affixed to the building support. Each of the first clip and the second clip respectively includes a baseplate, a coupling arm, and a groove defined by the coupling arm. The baseplate is configured to affix to the respective one of the building support or the surface panel. The coupling arm protrudes from the baseplate and has an end tip. The groove includes an inlet opening, an inlet portion extending from the inlet opening, and an end portion extending from the inlet portion in a different direction than the inlet portion. The inlet opening and the end portion of the groove are each defined by the end tip of the coupling arm. The interlocking of the first clip and the second clip includes moving the surface panel relative to the building support such that the coupling arm of the first clip is disposed in the groove of the second clip and the coupling arm of the second clip is disposed in the groove of the first clip.

DRAWINGS

Like numbers represent like features.

DETAILED DESCRIPTION

This disclosure relates to mounting a surface panel on a building support. More specifically, this disclosure relates to methods and devices for mounting interior surface panels.

Figure 1A:
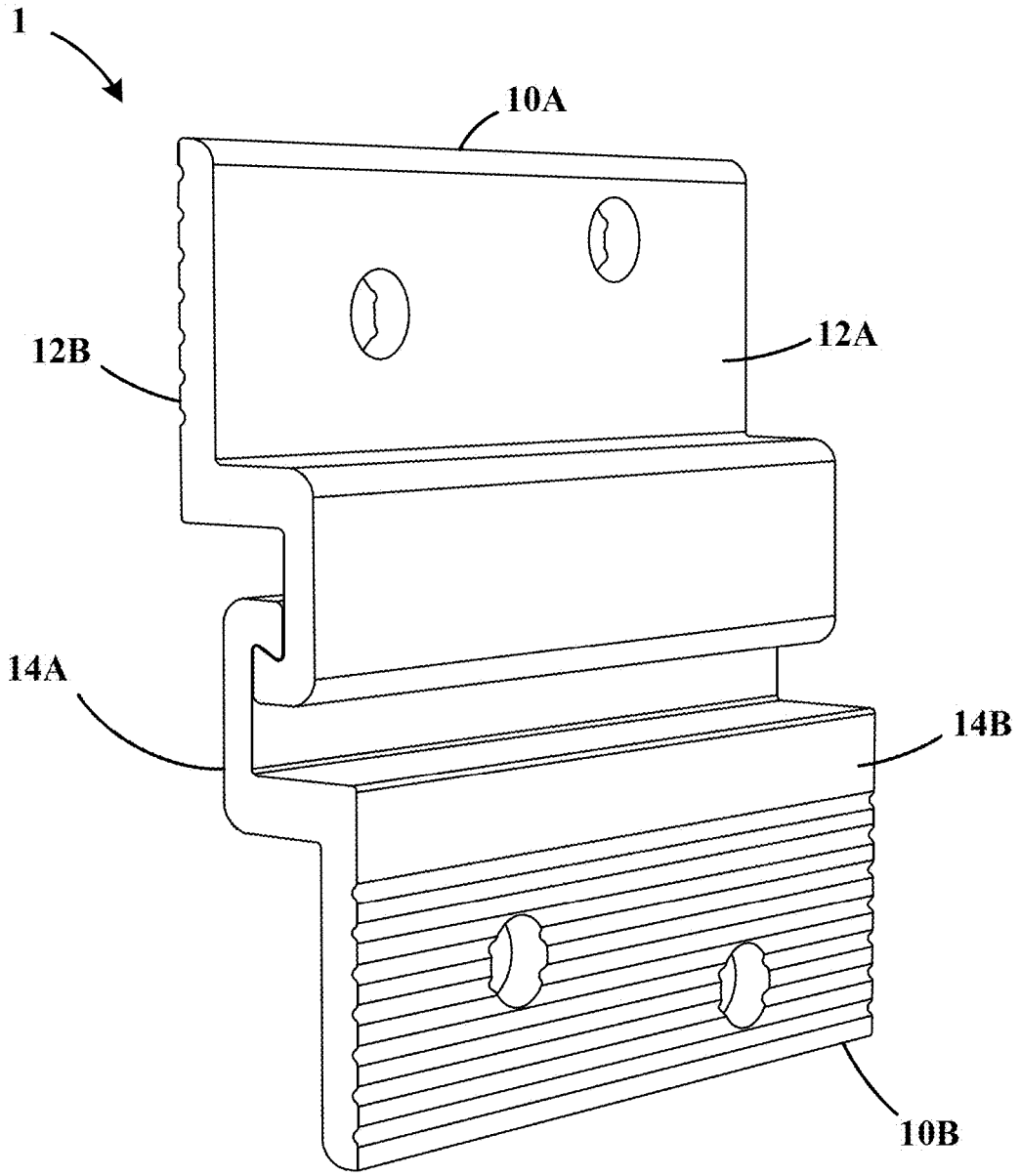
FIG. 1A is a front perspective view of an embodiment of interlocking clips for surface panel mounting system, in which the clips are interlocked.

FIGS. 1A-2B each a view of interlocking clips 10A, 10B for a surface panel mounting system 1. FIGS. 1A and 10A each show a front perspective view of the interlocking clips 10A, 10B. FIGS. 10A and 10B each show a side view of the interlocking clips 10A, 10B. The interlocking clips 10A, 10B include a first clip 10A and a second clip 10B that interlock together. FIGS. 1A and 10A shows the interlocking clips 10A, 10B when interlocked together. FIGS. 1B and 10B shows the interlocking clips 10A, 10B when separated from each other. The interlocking clips 10A, 10B are used for coupling a surface panel (e.g., surface panel 190 in FIG. 3A, surface panel 290 in FIG. 5A) to a building support (e.g., building support 195 in FIG. 3A, building support 295 in FIG. 5A).

The clips 10A, 10B can have similar features. As shown in FIG. 1, the clips 10A, 10B in some embodiments may have the same feature. It should be appreciated that the clips 10A, 10B may have features that are different in other embodiments. For brevity, features may be generally described with respect to the first clip 10A or generally with without reference to a specific one of the clips 10A, 10B. It should be appreciated that the second clip 10B may independently have features as described herein for the first clip 10A, and/or features generally described for the clips 10A, 10B may be applied to one or both of the clips 10A, 10B. "A" is generally used to indicate features of the first clip 10A and "B" is used to indicate features of the second clip 10B.

Each clip 10A, 10B includes a front 12A, 12B and a rear 14A, 14B opposite to the front 12A, 12B. The first clip 10A is configured to be affixed to a building support (e.g., building support 195 in FIGS. 3A-3E), and the rear 14A of the first clip 10A is configured to contact said building support. The second clip 10B is configured to be affixed to a surface panel (e.g., surface panel 190 in FIGS. 3A-3E), and the rear 14B of the first clip 10A contacts said building support.

Figure 1B:
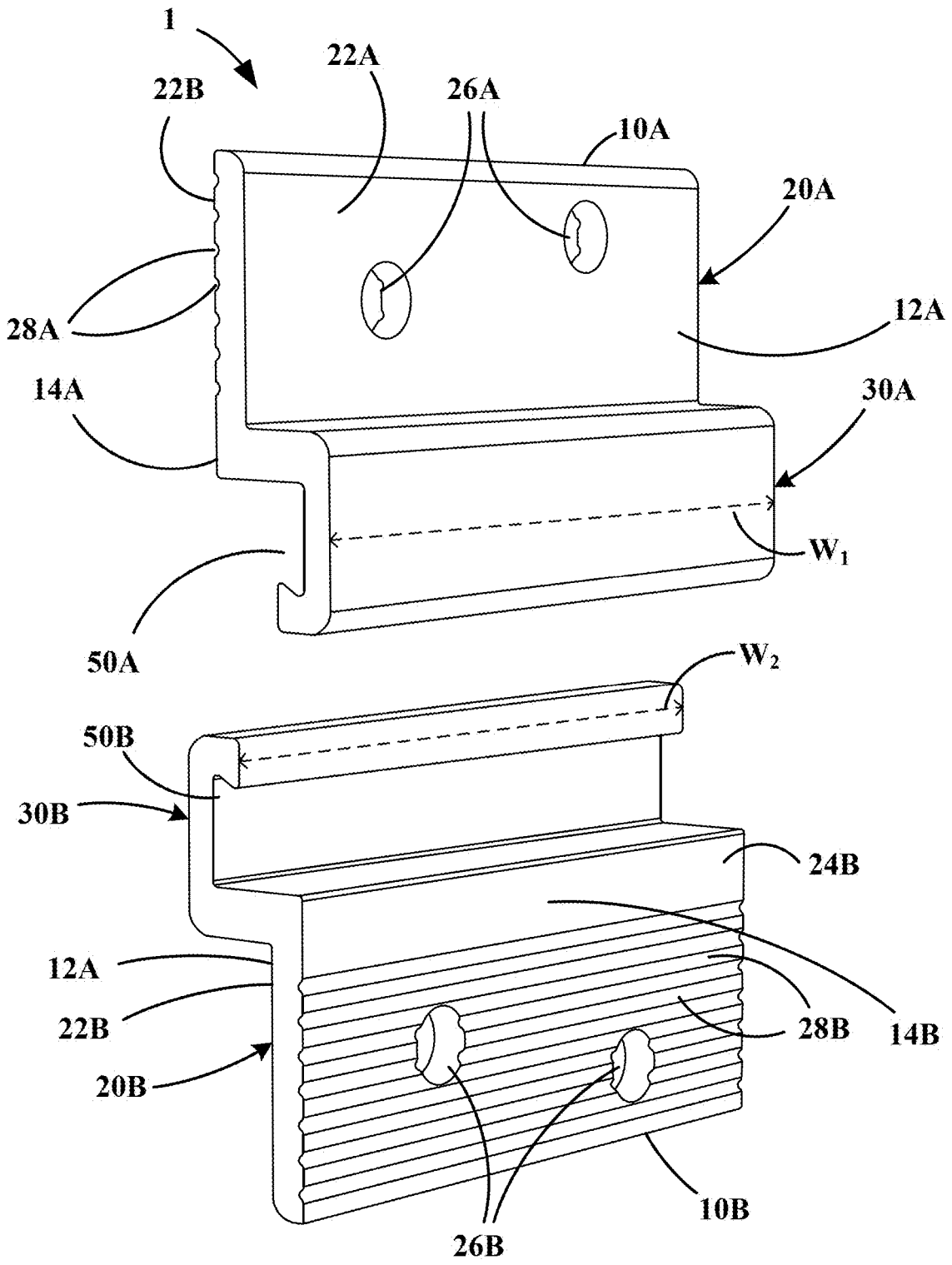
FIG. 1B is a front perspective view of the interlocking clips of FIG. 1A, in which the clips are separated, according to an embodiment.

The first clip 10A has a (first) width $W_1$, and the second clip has a (second) width $W_2$. As shown in FIG. 1B, the first clip 10A and the second clip 10B may have the same width (i.e., width $W_1$=width $W_2$). In another embodiment, the first clip 10A may have a longer width than the second clip 10B (e.g., width $W_1$>width $W_2$). The first clip 10A and the second clip 10B can each have a width $W_1$, $W_2$ of at least 2 inches. The first clip 10A and the second clip can each have a width $W_1$, $W_2$ of from 2 inches to 144 inches. In an embodiment, the first clip 10A and/or the second clip 10B can have a width $W_1$, $W_2$ of at least 4 inches. In an embodiment, the first clip 10A and/or the second clip 10B can have a width $W_1$, $W_2$ of at least 6 inches. In an embodiment, the first clip 10A and/or the second clip 10B can have a width $W_1$, $W_2$ of at least 12 inches. For example, at least one of the first clip 10A and the second clip 10B has a width $W_1$, $W_2$ of at or about 2.5 inches, at or about 72 inches, or 144 inches.

Each clip 10A, 10B includes a baseplate 20A, 20B, a coupling arm 30A, 30B, and a groove 50A, 50B. The baseplate 20A, 20B includes a front surface 22A, 22B and a rear surface 24A, 24B opposite to the front surface 22A, 22B. The front 12A, 12B of the clip 10A, 10B includes the front surface 22A, 22B of the baseplate 20A, 20B, and the rear 14A, 14B of the clip 10A includes the rear surface 24A, 24B of the baseplate 20A, 20B. The baseplates 20A, 20B are configured to be affixed to the building support (e.g., building support 195) and the surface panel, respectively. For example, the first clip 10A is configured to be affixed to the building support with the rear surface 24A contacting the building support. For example, the second clip 10B is configured to be affixed to the surface panel with the rear surface 24B contacting the surface panel.

As shown in FIG. 1, in the illustrated example, the baseplate 20A, 20B is configured to be affixed by having through-holes 26A, 26B in the baseplate 20A, 20B for affixing the baseplate 20A, 20B to the respective building support or surface panel. Fasteners (e.g., bolts, nails, or the like) (e.g., fasteners 198 in FIG. 3A) are inserted through the through-holes 26A, 26B and into the respective building support or surface panel to affix the baseplate 20A, 20B to the respective building support or surface panel. The rear surface 24A, 24B may include ridges 28A, 28B to help prevent slippage between the rear surface 24A, 24B of the baseplate 20A, 20B and the surface of the respective building support or surface panel. In another embodiment, the baseplate 20A, 20B may be configured to be affixed using an adhesive. In such an embodiment, the rear surface 24A, 24B of the baseplate 20A, 20B may be configured (e.g., roughened, treated, made of a material that promotes adhesive adhesion, etc.) for adhesively affixing the baseplate 20A, 20B to the respective building support or surface panel.

As shown in FIGS. 1A and 1B, the coupling arms 30A, 30B of the two clips 10A, 10B interlock to interlock the two clips 10A, 10B. The coupling arm 30A, 30B protrudes from the baseplate 20A, 20B. For example, the coupling arm 30A, 30B protrudes from the front surface 22A, 22B of the baseplate 20A, 20B. The coupling arm 30A, 30B includes an end tip 32A, 32B. The end tip 32A, 32B and the baseplate 20A, 20B are at opposite ends of the coupling arm 30A, 30B (e.g., the end tip 32A, 32B forms the distal end of the coupling arm 30A, 30B opposite to the other end of coupling arm 30A, 30B connected to the baseplate 20A, 20B).

Figure 2A:
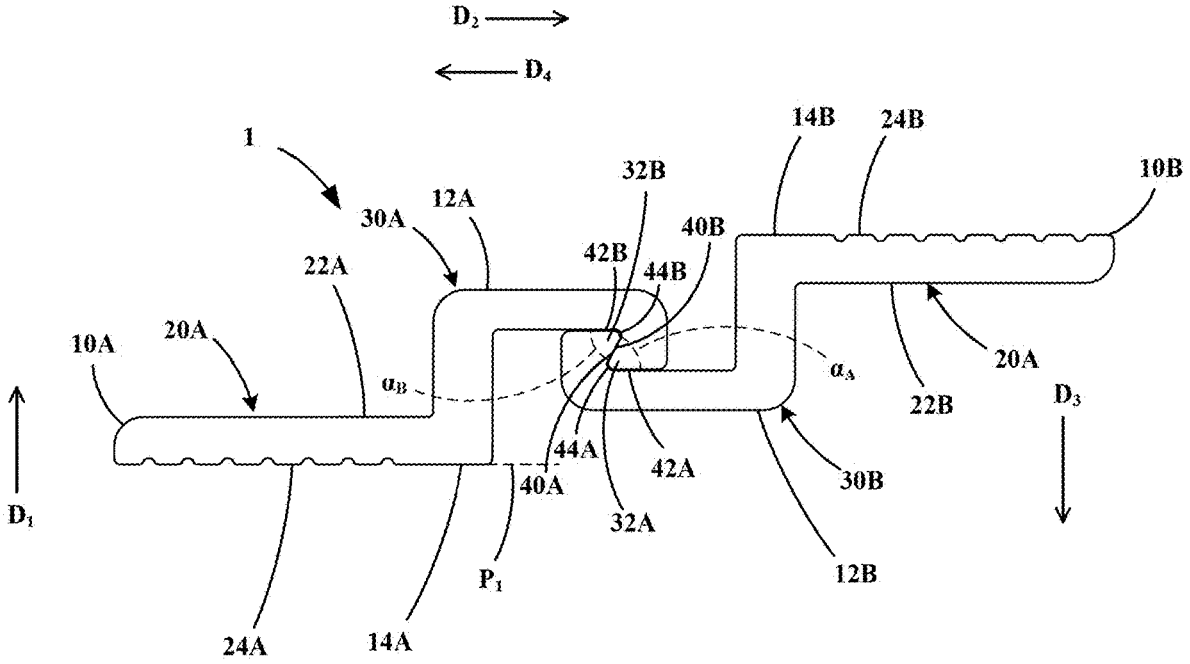
FIG. 2A is a side view of the interlocking clips in FIG. 1A, according to an embodiment.

The coupling arm 30A, 30B may include a neck 34A, 34B and a hook portion 36A, 36B that extends from the neck 34A (e.g., extends from a distal end of the neck 34A, 34B). The neck 34A, 34B connects the baseplate 20A to the hook portion 36A, 36B. As shown in FIG. 2A, the hook portion 36A, 36B has a hook shape. For example, the hook shape of the hook portion 36A, 36B and the neck 34A, 36B form the groove 50A, 50B. The hook portion 36A, 36B includes the end tip 32A, 32B of the coupling arm 30A, 30B.

The hook portion 36A can include a first intermediate portion 38A and a second intermediate portion 39A. The first and second intermediate portions 38A, 39A connect the neck 34A to the end tip 32A. The first intermediate portion 38A extends from the neck 34A (e.g., from a distal end of the neck 34A), and the second intermediate portion 39A extends from the first intermediate portion 38A. The end tip 32A extends from the second intermediate portion 39A (e.g., from a distal end of the second intermediate portion 39A). For example, the first intermediate portion 38A connects the neck 34A to the second intermediate portion 39A, and the second intermediate portion 39A connects first intermediate portion 38A to the end tip 32A. Each of the neck 34A, the first intermediate portion 38A, the second intermediate portion 39A, and the end tip 32A extend in a different direction. For example, the neck 34A extends in a first direction $D_1$, the first intermediate portion 38A extends in a second direction $D_2$, the second intermediate portion 39A extends in a third direction $D_3$, and end tip 32A extends in a fourth direction $D_4$, and the first, second, third, and fourth directions $D_1$, $D_2$, $D_3$, $D_4$ are all different from each other.

The groove 50A, 50B is formed in the rear 14A, 14B of the clip 10A, 10B. The groove 50A, 50B is defined by the coupling arm 30A, 30B. For example, the groove 50A, 50B is a groove formed in/by the coupling arm 30A, 30B. The groove 50A, 50B may not overlap with the baseplate 20A, 20B (e.g., does not overlap vertically or horizontally; does not overlap with the baseplate 20A, 20B in a side view of the clip(s) 10A, 10B). The groove 50A, 50B extends into the coupling arm 30A, 30B in multiple directions (e.g., groove 50A in FIG. 2A extends in direction $D_1$ and then in direction $D_2$).

The groove 50A, 50B in each clip 10A, 10B is configured to receive the coupling arm 30A, 30B of the other clip 10A, 10B. For example, the groove 50A in the first clip 10A is configured to receive the coupling arm 30B of the second clip 10B, and the groove 50B in the second clip 10B is configured to receive the coupling arm 30A of the first clip 10A. At least the end tip 32A, 32B of each coupling arm 30A, 30B is disposed in the groove 50A, 50B of the other clip 10A, 10B. When interlocked, the end tips 32A, 32B are in contact with each other.

In the illustrated embodiment, the clips 10A, 10B are configured such that the insertion of each coupling arm 30A, 30B into the groove 50A, 50B of the other clip 10A, 10B occurs simultaneously. For example, the movement of the clips 10A, 10B to insert the coupling arm 30A of the first clip 10A into the groove 50B of the second clip 10B also inserts the coupling arm 30B of the second clip 10B into the groove 50A of the first clip 10A.

Figure 2B:
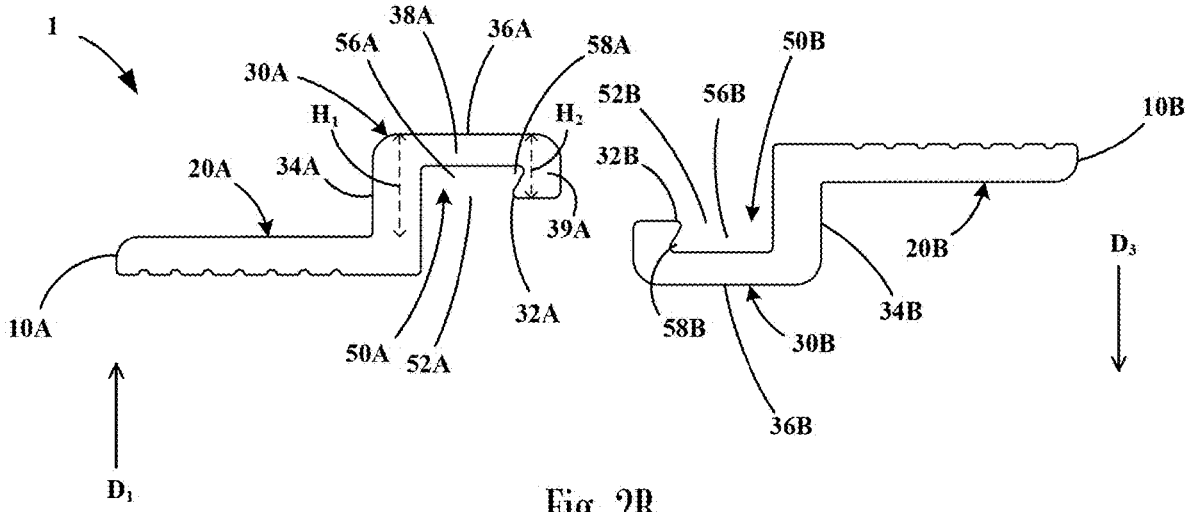
FIG. 2B is a side view of the interlocking clips in FIG. 1B, according to an embodiment.

As shown in FIG. 2B, the groove 50A, 50B includes an inlet opening 52A, 52B. The inlet opening 52A, 52B is defined by the coupling arm 30A, 30B (e.g., inlet opening 52A, 52B is an opening formed the coupling arm 30A, 30B). The groove 50A, 50B also includes an inlet portion 56A, 56B and an end portion 58A, 58B. The inlet portion 56A, 56B of the groove 50A, 50B extends from the inlet opening 52A, 52B (e.g., extends from the inlet opening 52A, 52B into the clip 10A, 10B, extends from the inlet opening 52A, 52B into the coupling arm 30A, 30B). The end portion 58A, 58B of the groove 50A, 50B extends from the inlet portion 56A, 56B of the groove 50A, 50B.

The inlet opening 52A, 52B of the groove 50A, 50B is defined by the end tip 32A, 32B of the coupling arm 30A, 30B. For example, one edge of the inlet opening 52A, 52B is defined by the end tip 32A, 32B of the coupling arm 30A, 30B and another edge of the inlet opening 52A, 52B is defined by the neck 34A of the coupling arm 30A, 30B.

As shown in FIG. 2B, the coupling arm 30A, 30B is disposed above the baseplate 20A, 20B. For example, the entire coupling arm 30A, 30B can be disposed above the baseplate 20A, 20B. The neck 34A, 34B has a first height $H_1$ and the hook portion 36A, 34B has a second height $H_2$. For example, height is measured in a thickness direction of the baseplate 20A, 20B (e.g., in direction $D_1$, in direction $D_3$). The neck 34A, 34B has a greater height than the hook portion 36A, 34B (i.e., $H_1>H_2$). This can dispose the coupling arm 30A, 30B above the baseplate 20A, 20B and such that the clip 10A, 10B when affixed to the respective building support or surface panel provides a slot (e.g., slot 111A, slot 111B in FIG. 3A) between the surface of the building support or surface panel and the coupling arm 30A. The slot can allow for the coupling arm 30A, 30B of the other clip 10A, 10B to be inserted into the groove 50A, 50B and the end tip 32A of said coupling arm 30A, 30B to be disposed in the end portion 58A, 58B of the groove 50A, 50B.

The end portion 58A, 58B has a decreasing thickness (e.g., the cross-section of the end portion 58A, 58B decreases as the end portion 58A, 58B extends away from the inlet portion 56A, 56B). The end portion 58A, 58B is a deepest portion of the groove 50A, 50B. The end portion 58A, 58B of the groove 50A, 50B is defined by the end tip 32A of the of the coupling arm 30A, 30B. For example, the end portion 58A is formed by the end tip 32A and the first and second intermediate portions 38A, 39A of the coupling arm 30A, 30B.

The end tip 32A, 32B of the coupling arm 30A, 30B includes an inner side 40A, 40B, an outer side 42A, 42B, an apex 44A, 44B that connects the inner side 40A, 40B to the outer side 42A, 42B. The inner side 40A, 40B may define the end portion 58A, 58B of the groove 50A, 50B (e.g., the inner side 40A, 40B is a side of the end portion 58A, 58B of the groove 50A, 50B). The apex 44A, 44B may define the inlet opening 52A, 52B of the groove 50A, 50B. An angle $\alpha_A$, $\alpha_B$ of the apex 44*a*, 44*b* is less than 90 degrees. In another embodiment, the angle $\alpha_A$, $\alpha_B$ of the apex 44*a*, 44*b* may be at or less than 75 degrees. In another embodiment, the angle $\alpha_A$, $\alpha_B$ of the apex 44*a*, 44*b* may be at or less than 65 degrees. The angle $\alpha_A$, $\alpha_B$ is the angle between the inner side 40A, 40B and the outer side 42A, 42B of the end tip 32A, 32B (e.g., an interior angle of the end tip 32A, 32B). The inner side 40A of the end tip 32A, 32B can also be angled relative to a plane of the baseplate 20A, 20B of the clip 10A, 10B (e.g., relative to a plane $P_1$ of the baseplate 20A, 20B as defined by the rear surface 24A, 24B of the baseplate 20A, 20B).

When the clips 10A, 10B are interlocked, the inner side 40A of the end tip 32A of the first clip 10A contacts (e.g., lays against) the inner side 40B of the end tip 32B of the second clip 10B. The outer side 42A of the end tip 32A of the first clip 10A contacts an inner surface of the coupling arm 30B of the second clip 10B that defines the inlet portion 56B of the groove 50B of the second clip 10B. The outer side 42B of the end tip 32B of the second clip 10B contacts an inner side of the coupling arm 30A of the first clip 10A that defines the inlet portion 56A of the groove 50A of the first clip 10A.

FIGS. 3A-3E show schematic side views of attachment of a surface panel 190 to a building support 195 using interlocking clips 10A, 10B of a surface panel mounting system 100. Each of FIGS. 3A-3E shows the surface panel in a different position relative to the surface panel 190 during the mounting of the surface panel 190 to the building support 195.

The surface panel mounting system 100 is configured for mounting a surface panel 190 that is a rigid surface panel. For example, the surface panel 190 can be a made of a rigid material such as, but not limited to, one or more of wood, laminate, wood composite, metal, polymer composite, etc. For example, the surface panel 190 may be, but is not limited to, a fiberboard (e.g., medium density fiberboard, high density fiberboard), a particleboard, plywood board, a honeycomb board, a high pressure laminate board, etc. The surface panel 190 may include a core of the rigid material with a surface finish provide thereon. The surface finish may be, but is not limited to, one or more of a vencer, laminate, paint, stain, etc. In some examples, the interlocking clips 10A, 10B may be used to mount other types of panels to a building support 195.

The building support 195 is a support of a building provided for supporting interior surfaces (i.e., a wall or ceiling) within a building. For example, the building support 195 may be, but is not limited to, one or more of support structure(s) (e.g., joist(s), rafter(s), framing, etc.), intermediate substrate(s) (e.g., furring strip(s), an intermediate substrate affixed to the supports structures for attaching interior panels, a previous wall/ceiling being renovated with interior panels, plywood paneling affixed to the support structure(s), etc.), etc. of the building.

The interlocking clips 10A, 10B may be made of a metallic material (e.g., metal, metal alloy, etc.). In one example, the interlocking clips 10A, 10B can be made of metal (e.g., aluminum, etc.). The interlocking clip 10A, 10B can have an extrudable shape, such that the interlocking clips 10A, 10B can each be made via extrusion (e.g., metal extrusion, etc.). The through-holes 26A, 26B can be provided after extrusion.

Figure 3A:
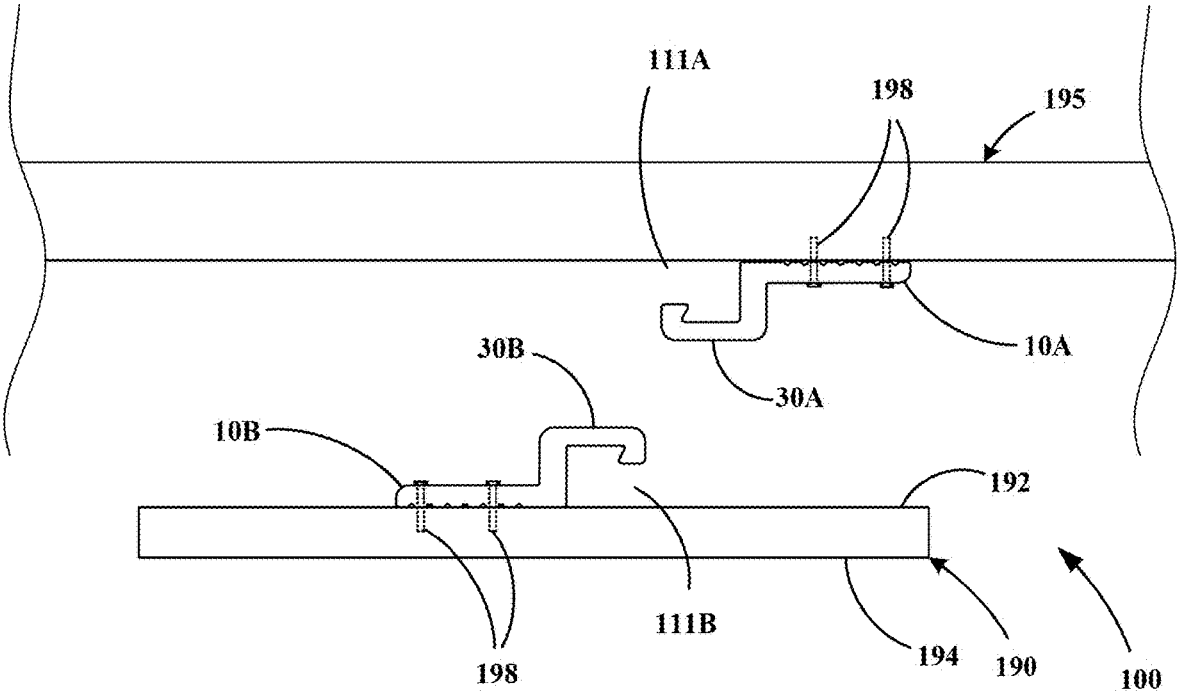
FIG. 3A shows a schematic side view of an embodiment of a surface panel mounting system for attaching a surface panel, in which the surface panel is in a first attachment position.

In FIG. 3A, the interlocking clips 10A, 10B are affixed to the building support 195 and the surface panel 190, respectively. The first clip 10A is affixed to the building support 195, and the second clip 10B is affixed to the surface panel 190. For example, the second clip 10B is attached to an outward side 192 of the surface panel 190 (e.g., side 192 configured to not be facing the interior space). The inward side 194 of the surface panel 190 may be configured to be visible side when the surface panel 190 is attached to the building support 195 (e.g., side 194 configured to be facing the interior space of the room/building). Each of the clips 10A, 10B can be affixed using one or more fasteners 198. For example, the fastener 198 extend through the through-holes 26A, 26B in the baseplate 22A, 22B of the clips 10A, 10B. It should be appreciated that the clips 10A, 10B may be affixed in a different manner in other embodiments as discussed herein (e.g., using an adhesive).

A slot 111A is formed between the first clip 10A and the building support 195. In particular, the slot 111A is formed by/between the building support 195 and the coupling arm 30A of the first clip 10A. A slot 111B is also formed between the second clip 10B and the surface panel 190. In particular, the slot 111B is formed by/between the surface panel 190 and the coupling arm 30B of the second clip 10B (e.g., slot 111B formed between the outward side 192 of the surface panel 190 and the coupling arm 30B of the second clip 10B).

Figure 3B:
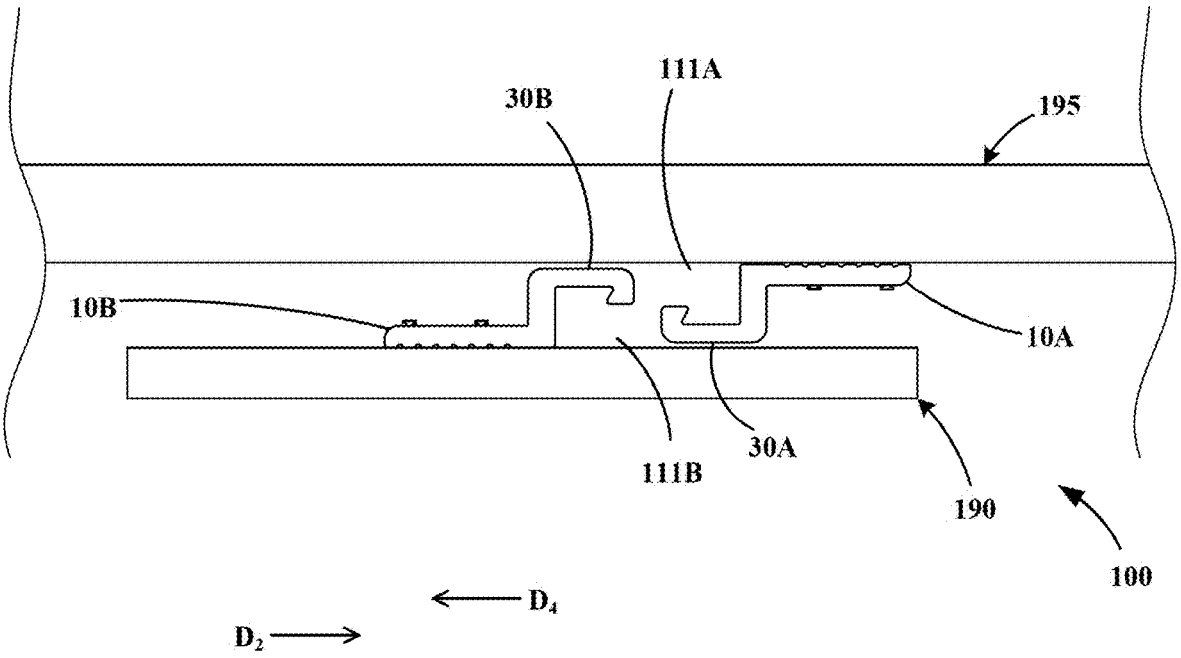
FIG. 3B shows a schematic side view of the surface panel mounting system of FIG. 3A, in which the surface panel is in a second attachment position, according to an embodiment.

In FIG. 3B, the surface panel 190 with the affixed second clip 10B is positioned relative to the first clip 10A such that the coupling arm 30B of the second clip 10B aligns with the slot 111A (e.g. aligned with the opening for the slot 111A). This position of the panel 190 also aligns the coupling arm 30A of the first clip 10A with the slot 111B (e.g., aligned with an opening for the slot 111B). The alignment is in a direction perpendicular to the plane of the surface panel 190 (e.g., in direction $D_3$, in direction $D_4$).

Figure 3C:
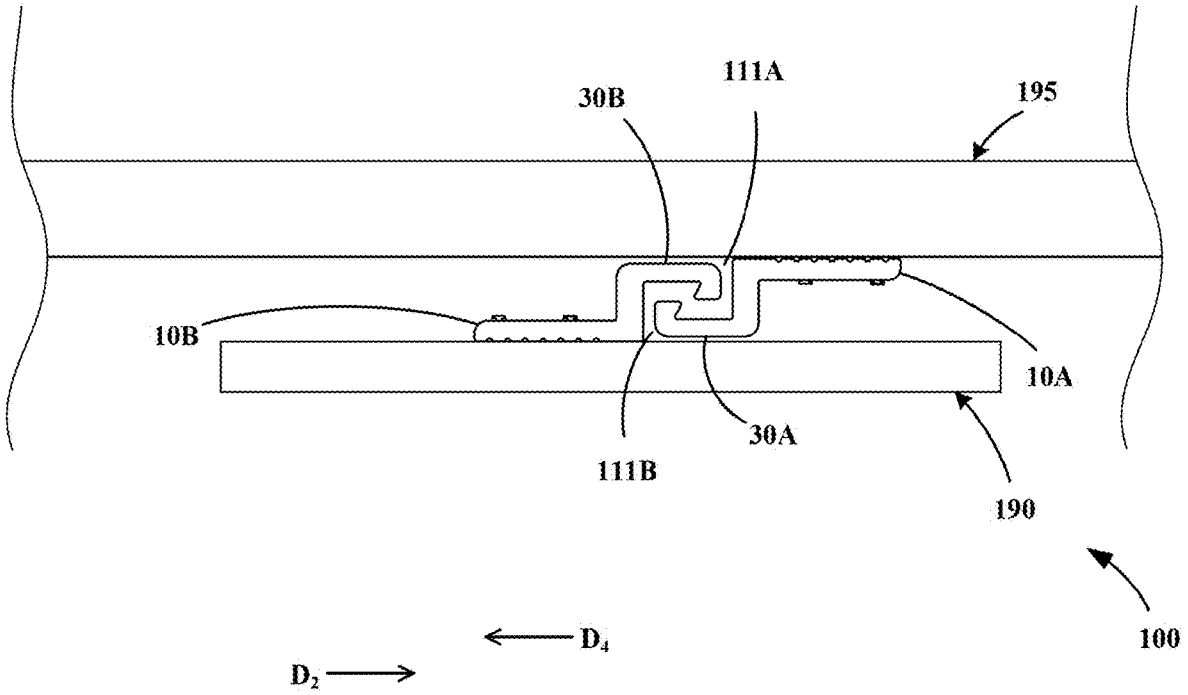
FIG. 3C shows a schematic side view of the surface panel mounting system of FIG. 3A, in which the surface panel is in a third attachment position, according to an embodiment.

In FIG. 3C, the surface panel 190 with the affixed second clip 10B is moved to position the second clip 10B closer to the first clip 10A affixed to the building support 195. As shown in FIG. 3C, this movement of the surface panel 190 inserts the coupling arm 30A of the first clip 10A into the slot 111B and inserts the coupling arm 30B of the second clip 10B into the slot 111A. The movement is in a direction (e.g., direction $D_2$ in FIGS. 3B and 3C) perpendicular to the surfaces of the building support 195 and the surface panel 190 (e.g., perpendicular to the plane of the surface panel 190, perpendicular to the outward side 192 of the surface panel 190).

Figure 3D:
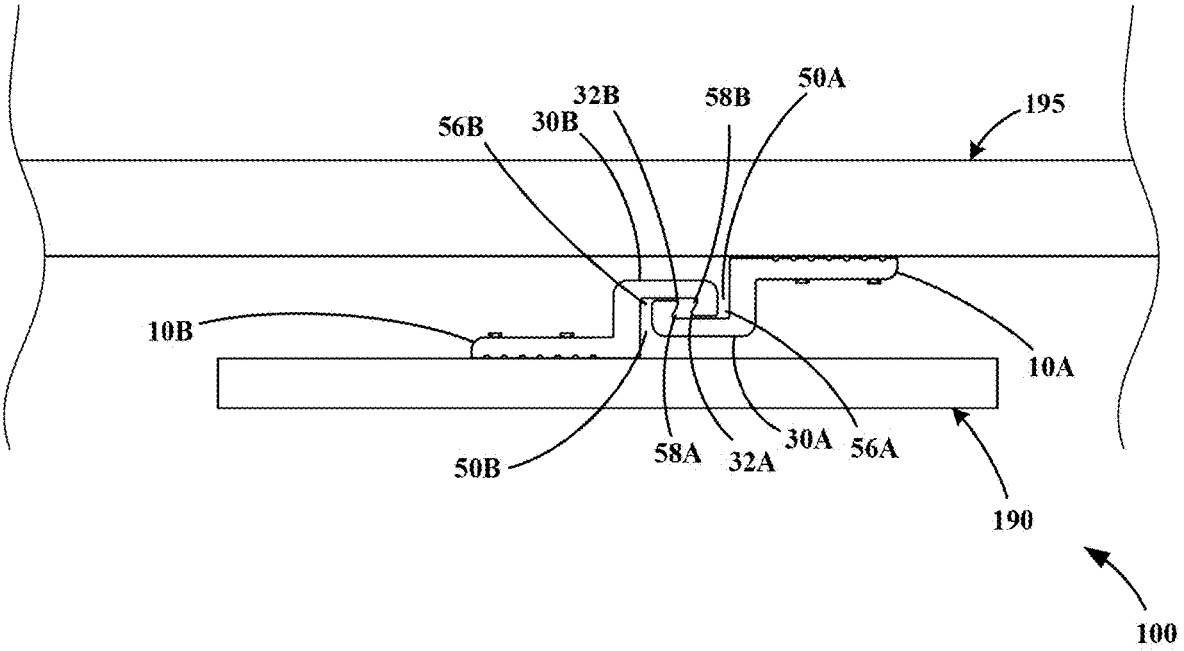
FIG. 3D shows a schematic side view of the surface panel mounting system of FIG. 3A, in which the surface panel is in a fourth attachment position, according to an embodiment.

In FIG. 3D, the panel 190 with the affixed second clip 10B is moved away from building support 195. The movement of the panel 190 away from the building support 195 inserts the end tip 32A, 32B of each coupling arm 30A, 30B into the groove 50A, 50B of the other clip 10A, 10B (e.g., inserts end tip 32A through the inlet opening 52A into the groove 50A, inserts end tip 32B through the inlet opening 52B into the groove 50B). In this position (as shown in FIG. 3D), the end tip 32A of each coupling arm 30A, 30B is disposed in the inlet portion 56A, 56B of the groove 50A, 30B of the other clip 10A, 10B (e.g., end tip 32A disposed in the inlet portion 56A of the groove 50A, the end tip 32B disposed in the inlet portion 56B of the groove 50B). For example, in this position (as shown in FIG. 3D), the end tip 32A, 32B of each coupling arm 30A, 30B is not disposed in the end portion 58A, 58B of the corresponding groove 50A, 50B.

Figure 3E:
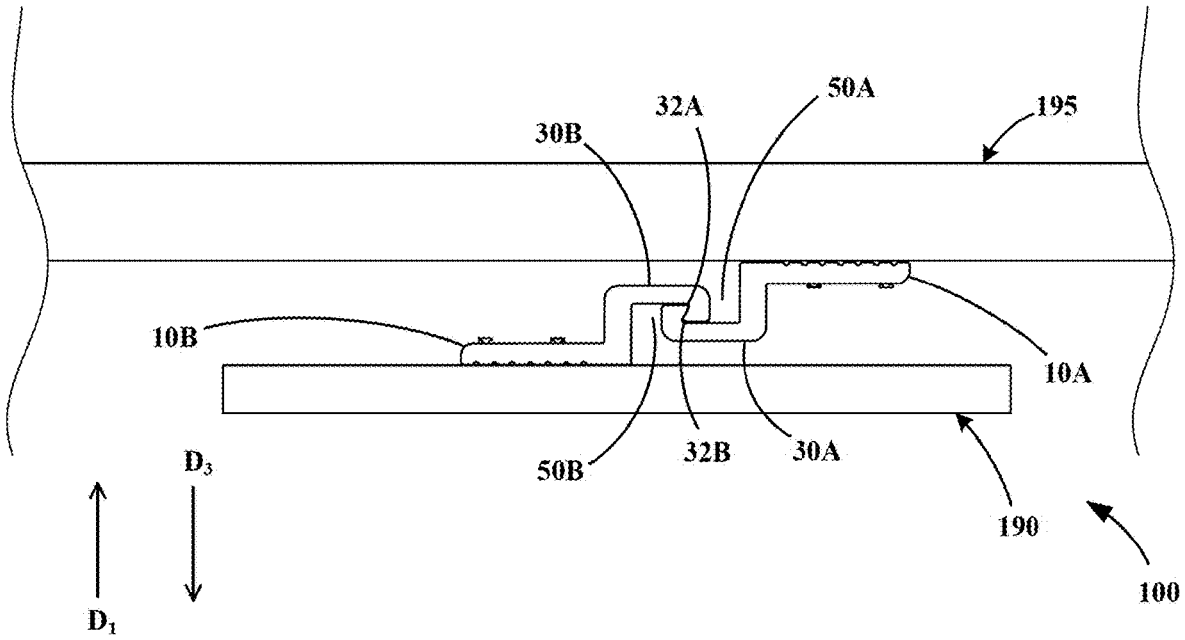
FIG. 3E shows a schematic side view of the surface panel mounting system of FIG. 3A, in which the surface panel is attached, according to an embodiment.

In FIG. 3E, the panel 190 with affixed second clip 10B is moved away from the first clip 10A (e.g., away from the baseplate 10A of the affixed second clip 10B). The panel 190 is moved in a direction (e.g., direction $D_4$ in FIG. 3E) away from the first clip 10A that is the opposite to the direction (e.g., direction $D_2$ in FIG. 3C) for the insertion of the first clip 10A into the slot 111A formed between the first clip 10A and the building support 195. The movement of the panel 190 interlocks the first clip 10A with the second clip 10B. In particular, the movement of the panel 190 inserts the end tip 32A, 32B of each coupling arm 30A, 30B into the end portion 58A, 58B of the groove 50A, 30B of the other clip 10A, 10B (e.g., end tip 32B disposed in the end portion 58A of the groove 50A, the end tip 32A disposed in the end portion 58B of the groove 50B).

In the interlocked position (as shown in FIG. 3E), the end tips 32A, 32B of the coupling arms 30A, 30B are positioned against each other. For example, in the interlocked position, the end tips 32A can prevent the arms 30A, 30B from being pulled away from each other (e.g., the surface panel 190 being pulled in a direction $D_3$ towards the building support 195). As previously discussed, the surface panel 190 can be used to form a ceiling or a wall (or a surface portion of the ceiling or wall) in the building. The weight of the surface panel (e.g., in direction $D_1$ in FIG. 3E) can also help prevent removal of the of the end tips 32A, 32B from the end portions 58A, 58B of the grooves 50A, 50B. The abutment of the surface panel 190 against an adjacent surface panel(s) (e.g., adjacent panels 390 shown in FIG. 5) and/or an adjacent wall/ceiling (or the surface panels thereof) can also help prevent the removal of the end tips 32A, 32B from the end portions 58A, 58B of the grooves 50A, 50B.

FIGS. 3A-3E show a surface panel mounting system 100 that includes one pair of interlocking clips 10A, 10B to mount the surface panel 190. In another example, the surface panel mounting system 1 may include multiple pairs of the interlocking clips 10A, 10B to mount the surface panel 190 to the building support 195. The positioning of the surface panel 190 (e.g., as discussed in FIGS. 3A-3E) interlocks each of the first clips with its corresponding second clip. The first clips can be configured to simultaneously interlock with their corresponding second clips.

Figure 4:
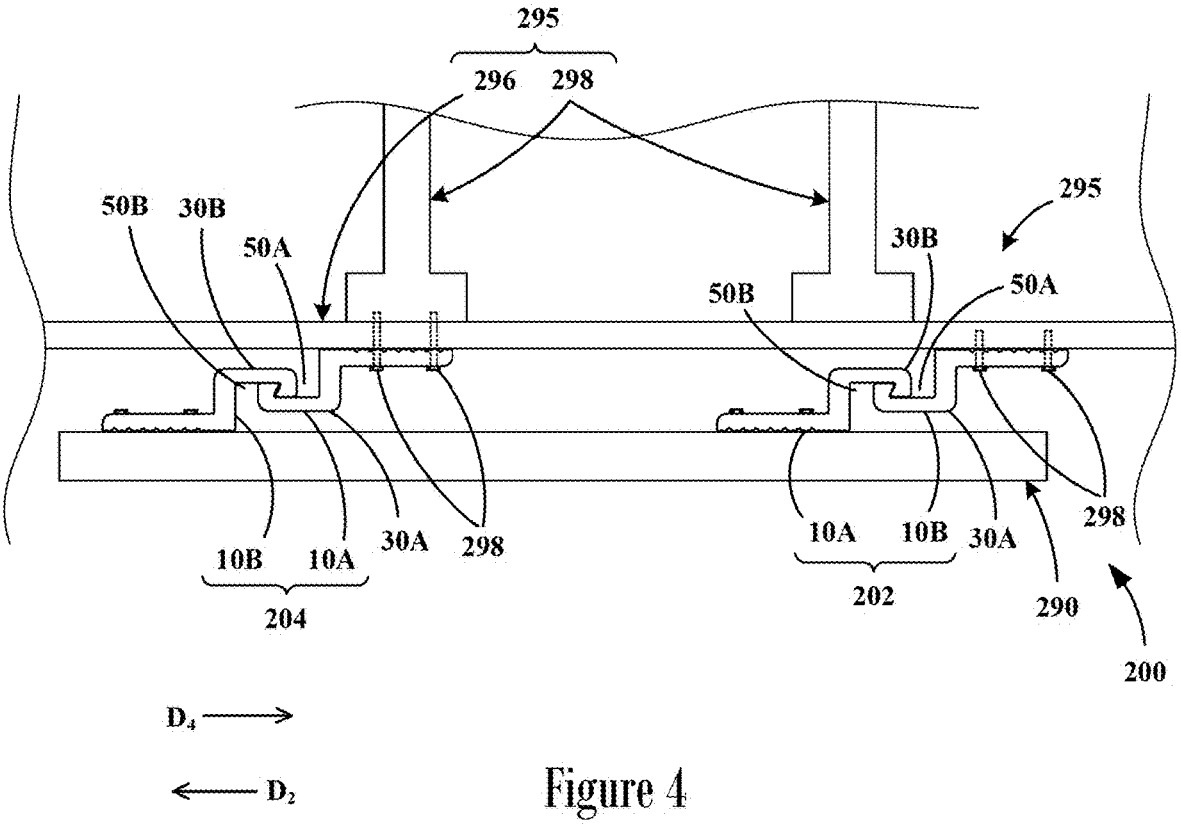
FIG. 4 is a schematic side view of another embodiment of a surface panel mounting system.

FIG. 4 shows a panel mounting system 200 for mounting a surface panel 290 to a building support 295. The surface panel 290 can have similar features as discussed for the surface panel 190 in FIGS. 3A-3E.

The panel mounting system 200 includes a first set of interlocking clips 202 and a second set of interlocking clips 204. Each set of interlocking clips 202, 204 includes a first clip 10A* and a second clip 10B*. The first clips 10A* and the second clips 10B* can have features as similarly described above for the first and second clips 10A, 10B in FIGS. 1-3E. The first clips 10A* are each affixed to the building support 295 and the second clips 10B* are each affixed to the surface panel 290 (e.g., similar to the first clip 10A and the second clip 10B in FIGS. 3A-3E).

The building support 295 includes joists 297 and an intermediate substrate 296. The joists 297 are one example of support structures of a building. The intermediate substrate 296 is affixed to the joists 297, and the surface panel 290 is mounted to the joists 297 via the intermediate substrate 296. In one example, interlocking clips 202, 204 may be configured to be provided every 12 inches for surface panels, while the joists 297 can be spaced apart 72 inches, and intermediate substate 296 allows for interlocking clips 202, 204 to be provided at different intervals than the joists 297.

As shown in FIG. 4, the second clip 10B* in the first set 202 is directly affixed to the joist 297 (e.g., fasteners 298 for the second clip 10B* in the first set 202 extend into and are affixed into the joist 298). The second clip 10B* in the first set 204 is affixed to the intermediate substrate 296 that is affixed to the joists 297. It should be appreciated that the second clips 10B* in embodiments may be affixed to the intermediate substrate 296, directly to the joist(s) 298, or a combination thereof.

The interlocking of the clips 10A*, 10B* in the first set 202 and the interlocking of the clips 10B*, 10B* in the second set 204 occurs simultaneously. The movement of the panel 290 inserts and interlocks each of the affixed first clips 10A* with its corresponding second clip 10B*. In some embodiments, the clips 10A*, 10B* in the panel mounting system 100 may be interlocked by sliding insertion (e.g., inserting the coupling arm of each clip into the groove of the other clip through the open end of each groove). In an embodiment, the ends of the grooves 50A, 50B of one of one or more of the clips 10A*, 10B* may have closed ends to prevent accidental removal.

Figure 5:
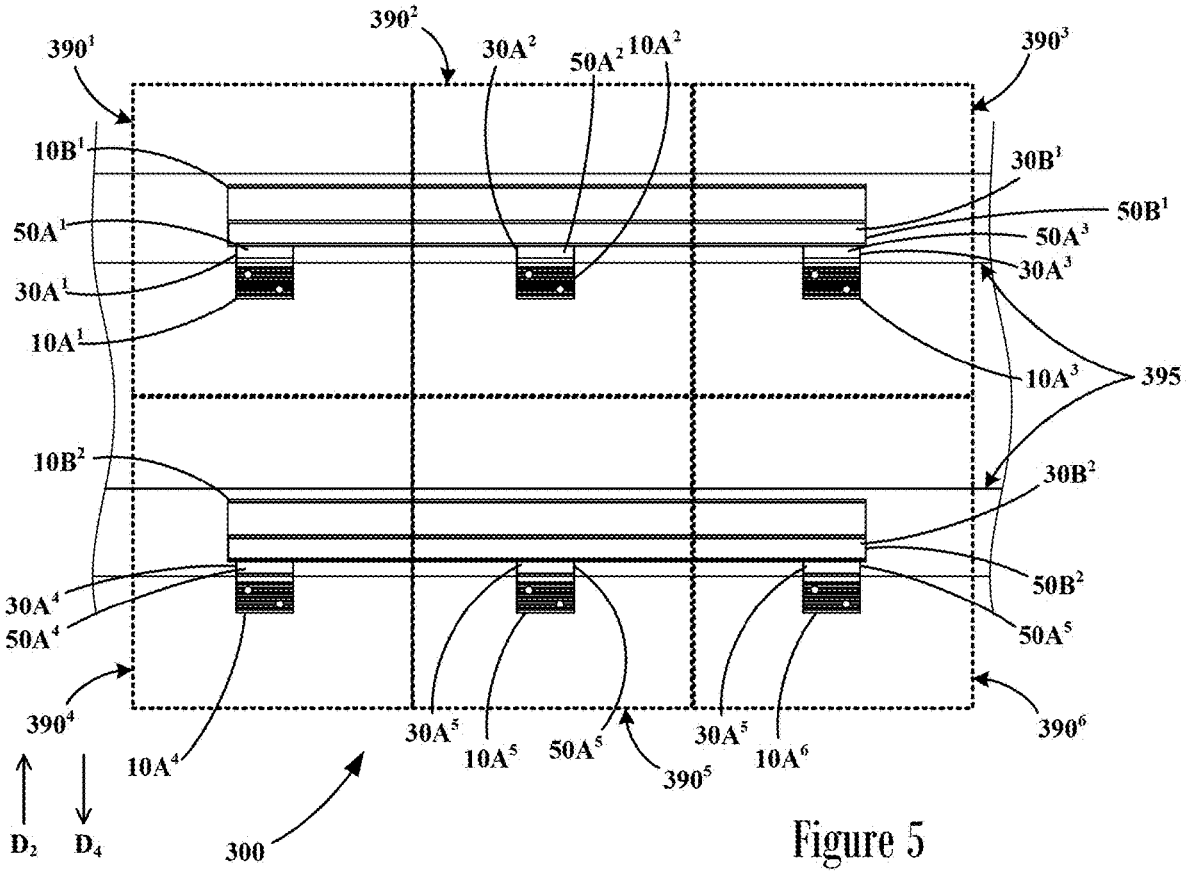
FIG. 5 is a schematic front view of an embodiment of a surface panel mounting system that is mounting a plurality of surface panels.

FIG. 5 shows a schematic front view of a mounting system 300 for mounting surface panels $390A^{1-6}$ to a building support 395. The mounting system 300 includes a plurality of first clips $10A^{1-6}$ and a plurality of second clips $10B^1$, $10B^2$. The first clips $10A^{1-6}$ and the second clips $10B^{1-6}$ can have features as similarly described above for the first and second clips 10A, 10B in FIGS. 1-3E. The surface panels 390$A^{1-6}$ can each have features as similarly described for the surface panel 190 in FIGS. 3A-3E. The building support 395 can have features as described for the building support 195 in FIGS. 3A-3E and/or for the building support 295 in FIG. 4.

The first clips 10$A^{1-6}$ are each affixed to the surface panels 390$A^{1-6}$ as similarly discussed for the first clips 10A, 10A* in FIGS. 1A-4. At least one first clip 10$A^{1-6}$ is affixed to each of the surface panels surface panels 390$A^{1-6}$. For example, first clip 10$A^1$ is affixed to a first surface panel 390$A^1$, first clip 10$A^2$ is affixed to a second surface panel 390$A^2$, first clip 10$A^3$ is affixed to a third surface panel 390$A^3$, first clip 10$A^4$ is affixed to a fourth surface panel 390$A^4$, first clip 10$A^5$ is affixed to a fifth surface panel 390$A^5$, a first clip 10$A^6$ is affixed to a sixth surface panel 390$A^6$. In FIG. 5, the mounting system 300 has one first clip 10$A^{1-6}$ affixed to each of the surface panels 390$A^{1-6}$. It should be appreciated that in another embodiment, the mounting system 300 may have multiple first clips 10$A^{1-6}$ affixed to each surface panel 390$A^{1-6}$ (e.g., as described for the surface panel 290 in FIG. 5).

The second clips 10$B^1$, 10$B^2$ are each affixed to the building support 395 as similarly discussed for the second clips 10B, 10B* in FIGS. 1A-4. As shown in FIG. 5, the second clips 10$B^1$, 10$B^2$ can be affixed to different portions of the building support 395 (e.g., different joists, framing, etc.).

The first clips and the second clips form sets of interlocking clips. As shown in FIG. 5, the mounting system 300 includes a different number of first clips and second clips (e.g., six first clips and two second clips). Each second clip 10$B^1$, 10$B^2$ interlocks with multiple first clips 10$A^{1-6}$. In the illustrated example, three first clips interlock with each second clip. A first set of first clips 10$A^1$, 10$A^2$, 10$A^3$ interlock with a one second clip 10$B^1$, and a second set of first clips 10$A^4$, 10$A^5$, 10$A^6$ interlock with another second clip 10$B^2$. Each first clip interlocks with its corresponding second clip in a similar manner as discussed with the first clip and the second clip in FIGS. 1A-3E. For example, the coupling arms 30$A^1$, 30$A^2$, 30$A^3$ of the first set of first clips 10$A^1$, 10$A^2$, 10$A^3$ interlock with the coupling arm 30$B^1$ of the first second clip 10$B^1$ (e.g., the coupling arms 30$A^1$, 30$A^2$, 30$A^3$ are each disposed in the groove 50$B^1$ of the second clip 10$B^1$, the coupling arm 30$B^1$ is disposed in the grooves 50$A^1$, 50$A^2$, 50$A^3$ of the first clips 10$A^1$, 10$A^2$, 10$A^3$). For example, the coupling arms 30$A^4$, 30$A^5$, 30$A^6$ of the second set of first clips 10$A^4$, 10$A^5$, 10$A^6$ interlock with the coupling arm 30$B^2$ of the second second clip 10$B^2$ (e.g., the coupling arms 30$A^4$, 30$A^5$, 30$A^6$ are each disposed in the groove 50$B^2$ of the second second clip 10$B^2$, and the coupling arm 30$B^2$ is disposed in the grooves 50$A^4$, 50$A^5$, 50$A^6$ of the first clips 10$A^4$, 10$A^5$, 10$A^6$).

As shown in FIG. 5, the mounted surface panels 390$A^{1-6}$ are disposed adjacent to each other. The surface panels 390$A^{1-6}$ can be mounted to abut each other to prevent decoupling of the interlocked clips. To decouple from its corresponding second clip 10$B^1$, 10$B^2$, a surface panel 390$A^{1-6}$ with its affixed first clip 10$A^{1-6}$ moves in a first direction (e.g., in direction $D_2$) to uncouple the end tips (e.g., end tips 32A, 32B in FIG. 3E) of the coupling arms 30$A^{1-6}$, 30$B^1$, 30$B^2$ of the first clip 10$A^{1-6}$ and the second clip 10$B^1$, 10$B^2$ from each other. For example in FIG. 5, the mounted surface panel 390$A^4$ has an end/edge that abuts an end/edge of the mounted surface panel 390$A^1$. This abutting of the mounted surface panel 390$A^4$ against the other mounted surface panel 390$A^1$ can prevent movement of the mounted surface panel 390$A^4$ in the first direction. Further, the other mounted surface panel 390$A^1$ may be prevented from moving in the first direction by its opposite end/edge (e.g., upper edge in FIG. 5) abutting another panel (not shown) or another opposing surface (not shown) (e.g., a wall, ceiling, a portion of the building support 395, etc.).

The terminology used herein is intended to describe particular embodiments and is not intended to be limiting. The terms "a," "an," and "the" include the plural forms as well, unless clearly indicated otherwise. The terms "comprises" and/or "comprising," when used in this Specification, specify the presence of the stated features, integers, steps, operations, elements, and/or components, but do not preclude the presence or addition of one or more other features, integers, steps, operations, elements, and/or components. In an embodiment, "connect", "affix" and/or "attach" as described herein can respectively refer to being "directly connect", "directly affixed", and "directly attach".

With regard to the preceding description, it is to be understood that changes may be made in detail, especially in matters of the construction materials employed and the shape, size, and arrangement of parts without departing from the scope of the present disclosure. This Specification and the embodiments described are exemplary only, with the true scope and spirit of the disclosure being indicated by the claims that follow.

What is claimed is:

1. Interlocking clips for a surface panel mounting system, comprising:

a first clip configured to affix to a building support; and a second clip configured to affix to a surface panel, wherein the first clip and the second clip each respectively include:

a baseplate configured to affix to the one respective of the building support or the surface panel, and a coupling arm protruding from the baseplate and having an end tip, the coupling arm including a neck extending from the baseplate and a hook portion extending from an end of the neck away from the baseplate, the end tip being a distal end of the hook portion from the baseplate, and a groove defined by the coupling arm, the groove including an inlet opening, an inlet portion extending from the inlet opening, and an end portion extending from the inlet portion in a different direction than the inlet portion, each of the inlet opening and the end portion of the groove being defined by the end tip of the coupling arm, wherein for each of the first clip and the second clip, the groove is configured to receive the coupling arm of a respective other one of the first clip and the second clip.

2. The interlocking clips of claim 1, wherein the end tip of the first clip has a shape that corresponds with a shape of the end tip of the second clip.

3. The interlocking clips of claim 1, wherein the groove of the first clip is configured to receive the coupling arm of the second clip simultaneously with the groove of the second clip receiving the coupling arm of the first clip.

4. The interlocking clips of claim 1, wherein the groove of each of the first clip and the second clip is configured to interlock with the coupling arm of the second clip and the first clip, respectively, such that a weight of the surface panel prevents separation of the first clip from the second clip.

5. The interlocking clips of claim 1, wherein the end tip of the coupling arm of the first clip includes an inner side, an outer side, and an apex connecting the inner side to the outer side, the inner side being angled relative to a plane of the baseplate of the first clip.

6. The interlocking clips of claim 5, wherein an angle of the apex is less than 90 degrees.

7. The interlocking clips of claim 5, wherein the first clip includes a front and a rear opposite to the front, the rear configured to contact the building support, the groove formed in the rear of the first clip, and the plane of the baseplate of the first clip is defined by the rear of the first clip.

8. The interlocking clips of claim 1, wherein the groove of the first clip is configured to receive the coupling arm of the second clip the first clip by insertion of the coupling arm of the second clip through the inlet opening of the groove of the first clip, the inlet opening defined by the coupling arm.

9. The interlocking clips of claim 1, wherein the neck has a first height, the hook portion has a second height, and the first height of the neck is greater than the second height of the hook portion, the first height and the second height each extending in a direction perpendicular to a plane of the baseplate.

10. The interlocking clips of claim 1, wherein the hook portion includes:

a first intermediate portion extending from the neck, and a second intermediate portion extending from the first intermediate portion, and the end tip extending from the second intermediate portion, wherein the first intermediate portion, the second intermediate portion, and the end tip form a hook shape.

11. The interlocking clips of claim 1, wherein the neck extends from the baseplate in a first direction, and the hook portion includes:

a first intermediate portion extending from the neck in a second direction, a second intermediate portion extending from the first intermediate portion in a third direction, and the end tip extending from the second intermediate portion in a fourth direction, and the first direction, the second direction, the third direction, and the fourth direction are different directions.

12. Interlocking clips for a surface panel mounting system, comprising:

a first clip configured to affix to a building support; and a second clip configured to affix to a surface panel, wherein the first clip and the second clip each respectively include:

a baseplate configured to affix to the one respective of the building support or the surface panel, a coupling arm protruding from the baseplate, the coupling arm including:

a neck extending from the baseplate in a first direction, a first intermediate portion extending from a distal end of the neck in a second direction perpendicular to the first direction, a second intermediate portion extending from a distal end of the first intermediate portion in a third direction perpendicular to the second direction, and an end tip extending from a distal end of the second intermediate portion in a fourth direction perpendicular to the third direction, wherein the first direction, the second direction, the third direction, and the fourth direction are different directions, and a groove defined by the coupling arm, the groove including an inlet opening, an inlet portion extending from the inlet opening, and an end portion extending from the inlet portion in a different direction than the inlet portion, each of the inlet opening and the end portion of the groove being defined by the end tip of the coupling arm, wherein for each of the first clip and the second clip, the groove is configured to receive the coupling arm of a respective other one of the first clip and the second clip.

13. The interlocking clips of claim 1, wherein the first clip and second clips are configured to interlock to hold a rigid surface panel mounted to the building support.

14. The interlocking clips of claim 1, wherein in a side view of the first clip, the groove does not overlap with the baseplate in a vertical direction and does not overlap the baseplate in a horizontal direction.

15. The interlocking clips of claim 1, wherein in a side view of the first clip, the hook portion and the baseplate extend to opposite sides of a plane of the neck of the coupling arm.

16. A method of attaching a surface panel to a building support, the method comprising:

interlocking a first clip affixed to the surface panel with a second clip affixed to the building support, the first clip and the second clip each respectively include a baseplate configured to affix to the one respective of the building support or the surface panel, and a coupling arm protruding from the baseplate and having an end tip, and a groove defined by the coupling arm, the coupling arm including a neck extending from the baseplate and a hook portion extending from an end of the neck away from the baseplate, the end tip being a distal end of the hook portion from the baseplate, the groove including an inlet opening, an inlet portion extending from the inlet opening, and an end portion extending from the inlet portion in a different direction than the inlet portion, each of the inlet opening and the end portion of the groove being defined by the end tip of the coupling arm, wherein the interlocking of the first clip and the second clip includes moving the surface panel relative to the building support such that the coupling arm of the first clip is disposed in the groove of the second clip and the coupling arm of the second clip is disposed in the groove of the first clip.

17. The method of claim 16, further comprising:

affixing the first clip to the surface panel, and affixing the second clip to the building support.

18. The method of claim 16, wherein the surface panel is a vertical surface panel.

19. The method of claim 16, wherein the moving of the surface panel relative to the building support includes inserting the first clip through a slot between the coupling arm of the second clip and a surface of the building support.

20. The method of claim 16, wherein the surface panel is a rigid surface panel.

* * * * *